US005314167A

United States Patent [19]

Holloman

[11] Patent Number: 5,314,167

[45] Date of Patent: May 24, 1994

[54] TEMPORARY RAIL STRUCTURE FOR A FLOOR

[75] Inventor: Jesse H. Holloman, Selma, N.C.

[73] Assignee: James N. Mitchell, Smithfield, N.C.; a part interest

[21] Appl. No.: 2,239

[22] Filed: Jan. 8, 1993

[51] Int. Cl.[5] ..... E04H 17/22

[52] U.S. Cl. ..... 256/69; 256/1; 256/DIG. 6; 52/DIG. 12; 182/113

[58] Field of Search ..... 256/DIG. 6, 1, 59, 65, 256/69; 52/DIG. 12; 182/113

[56] References Cited

U.S. PATENT DOCUMENTS

| | | | |
|---|---|---|---|
| 3,747,898 | 7/1973 | Warren | 256/59 |
| 3,756,568 | 9/1973 | Mocny et al. | 256/59 |
| 3,881,698 | 5/1975 | Marsh | 256/59 |
| 3,901,481 | 8/1975 | Probst | 256/59 |
| 3,920,221 | 11/1975 | Berry et al. | 256/59 |
| 3,938,619 | 2/1976 | Kurabayashi et al. | 182/113 |
| 3,995,833 | 12/1976 | McLaughlin et al. | 256/59 |
| 4,236,698 | 12/1980 | Compte | 256/DIG. 6 X |
| 4,363,467 | 12/1982 | Box | 256/59 X |

FOREIGN PATENT DOCUMENTS

| | | | |
|---|---|---|---|
| 2299472 | 8/1976 | France | 52/DIG. 12 |
| 2352134 | 12/1977 | France | 52/DIG. 12 |
| 2441696 | 6/1980 | France | 256/DIG. 6 |
| 2027768 | 2/1980 | United Kingdom | 52/DIG. 12 |

*Primary Examiner*—Dennis L. Taylor
*Assistant Examiner*—Christopher J. Novosad
*Attorney, Agent, or Firm*—Rhodes, Coats & Bennett

[57] ABSTRACT

The present invention relates to a temporary rail structure that includes a series of vertical posts that are interconnected by horizontally extending side rails. Each post is designed to clamp around the top portion of a band that extends around floor joist that support a sub-floor thereabove. Around the entire floor structure is formed a series of spaced apart openings, each opening cut in the sub-floor adjacent the inside of the band. Each temporary post includes a U-shaped yoke that includes one leg that is inserted downwardly through the opening formed in the sub-floor such that this leg extends adjacent the inside of the band. A screw-type tightener is secured to another leg of the yoke and is screwed from the outside so as to tighten down on the band.

7 Claims, 2 Drawing Sheets

TEMPORARY RAIL STRUCTURE FOR A FLOOR

FIELD OF THE INVENTION

The present invention relates to temporary rail structures and more particularly to a temporary rail structure designed to be used around the floor of a building during the construction process.

BACKGROUND OF THE INVENTION

For many years it has been recognized that buildings under construction present a safety problem. In particular, it is not uncommon for young children to come onto the property of a building that is under construction and to climb and move throughout the building during periods of time when the construction site is unattended. In this same regard, it is not unusual for children and adults as well to stumble, fall or trip while moving through and around the building site, often resulting in serious bodily injury. One particular area of a building that is under construction that presents a special problem is the floor of the building before the walls are actually erected. This is especially true with floors that extend high above the surrounding ground area such as second floor areas.

Beginning in 1993, OSHA will require some type of temporary railing structure around floor areas that are disposed a certain height above the surrounding ground.

There have been attempts at designing temporary rail structures for buildings under construction. For example, see the disclosures found in the following U.S. Patents: U.S. Pat. Nos. 3,747,898; 3,756,568; 3,881,698; 3,901,481; 3,920,221; 3,938,619; 3,995,833; 4,236,698; and 4,363,467.

However, to a large extent, most of these temporary rail structures are impractical and difficult to use. One of the main problems with temporary rail structures of the past is that they are difficult to handle and hard to attach to the floor structure. Temporary rail structures that are difficult to apply or attach to the open sided floor of a building under construction will not be used efficiently by building framers.

Therefore, there is a need for a reasonably inexpensive temporary rail structure for use by residential builders that is easy to erect and easy to disassemble.

SUMMARY AND OBJECTS OF THE INVENTION

The present invention entails a temporary rail structure for use by the building trades on floors that do not have surrounding side wall structures. In particular, the temporary rail structure of the present invention comprises a series of posts that are designed to be secured about the edge of a floor area and to receive and support a series of side railings. In order to accommodate the present invention, a hole is formed at various places around the floor in the sub-floor itself, adjacent the inside of a band that surrounds floor joists that support an overlying sub-floor. Each posts of the temporary rail structure of the present invention includes a lower yoke-shaped member that is designed to attach to the top portion of the surrounding band that extends around the floor joist of the floor system. The yoke includes an inside leg that extends through the opening formed in the sub-floor adjacent the inside of the band. On the outside leg of the yoke there is provided a screw-type tightener that is screwed into engagement with the outside of the band thereby pulling the inside leg of the yoke closely and tightly adjacent the inside of the band so as to secure the yoke and associated post structure to the band of the floor system. Thereafter, a series of these posts are secured in like manner to the floor structure. The respective posts are connected by a series of horizontal rails that extend from end-to-end and which are supported by vertically spaced rail holders formed on the post structure.

It is therefore an object of the present invention to provide a temporary railing structure for a floor system that is easy to erect and install and which is easy to dismantle.

Another object of the present invention is to provide a temporary railing structure for a floor system for a building under construction wherein the temporary railing structure is easy to handle and is relatively inexpensive.

Still a further object of the present invention resides in the provision of a temporary railing structure that is designed to mount directly to a band surrounding the floor system and in particularly designed to extend through an opening formed in the sub-floor.

Another object of the present invention is to provide a temporary railing structure that is compatible with all residential type floor systems under construction.

Other objects and advantages of the present invention will become apparent and obvious from a study of the following description and the accompanying drawings which are merely illustrative of such invention.

DETAILED DESCRIPTION OF THE INVENTION

Figure 1:
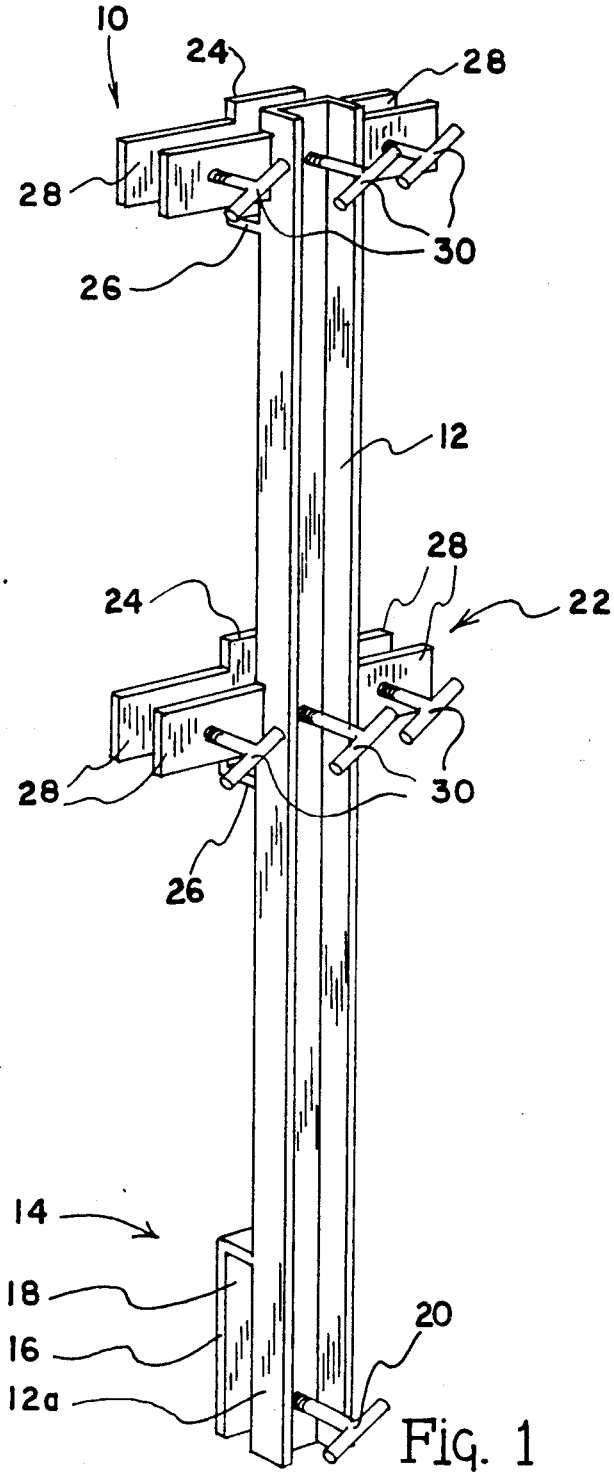
FIG. 1 is a perspective view of a temporary post that forms a part of the temporary railing structure of the present invention.

The present invention entails a temporary railing structure for use around a floor system of a building under construction. As previously noted, OSHA is about to implement regulations that require the erection of a temporary railing structure around a floor system of a building under construction. Apparently, the regulations will require that once a floor has been constructed that the same cannot be left unattended by the contractor or framer without there being a temporary rail erected around the open sided floor structure.

Before describing the temporary railing structure of the present invention, it may be beneficial to basically review the structure of a floor system. In this regard, a floor system will include a series of parallel floor joists FJ that support a floor or sub-floor SF there above. A band B will extend around the floor joists FJ and will define the perimeter of the floor system. As will be appreciated from subsequent portions of this disclosure, one important feature of the present invention relates to how the temporary railing structure is actually secured to the floor system. In this regard, the present invention entails forming holes or openings in the sub-floor SF at points around the parameter of the floor system. In particular, these openings are formed adjacent the inside of the band B at selected points around the floor system. As will be appreciated from subsequent portions of this disclosure, the railing structure of the present invention entails a series of posts with each post having a yoke-type attachment that fits down over the top portion of the band B. One leg of the yoke extends through the opening formed in the sub-floor SF.

Now turning to the drawings, the temporary railing structure of the present invention is shown therein and indicated generally by the numeral 10. The temporary railing structure 10 comprises a series of posts 12. The posts 12 in the embodiment disclosed are formed from channel iron but it is appreciated that other materials such as wood, plastic and the like can be utilized.

Formed on the lower end of each post is attaching means, indicated generally by the numeral 14, for attaching respective posts 12 to the band B. Attaching means 14 is in the form of a U-shaped yoke with the lower portion 12*a* of the post forming an outside leg of the U-shaped yoke attaching means 14. Attaching means 14 further includes an inside leg 16. Defined between the outside leg 12*a* and the inside leg 16 is a band cavity 18 that is designed to receive the band B of the floor system. Also forming a part of the attaching means 14 is a screw tightener 20 that is threaded into the outside leg 12*a*. It is therefore appreciated that the screw tightener 20 can be tightened down on band B that extends through the band cavity 18 of the attaching means 14.

Figure 2:
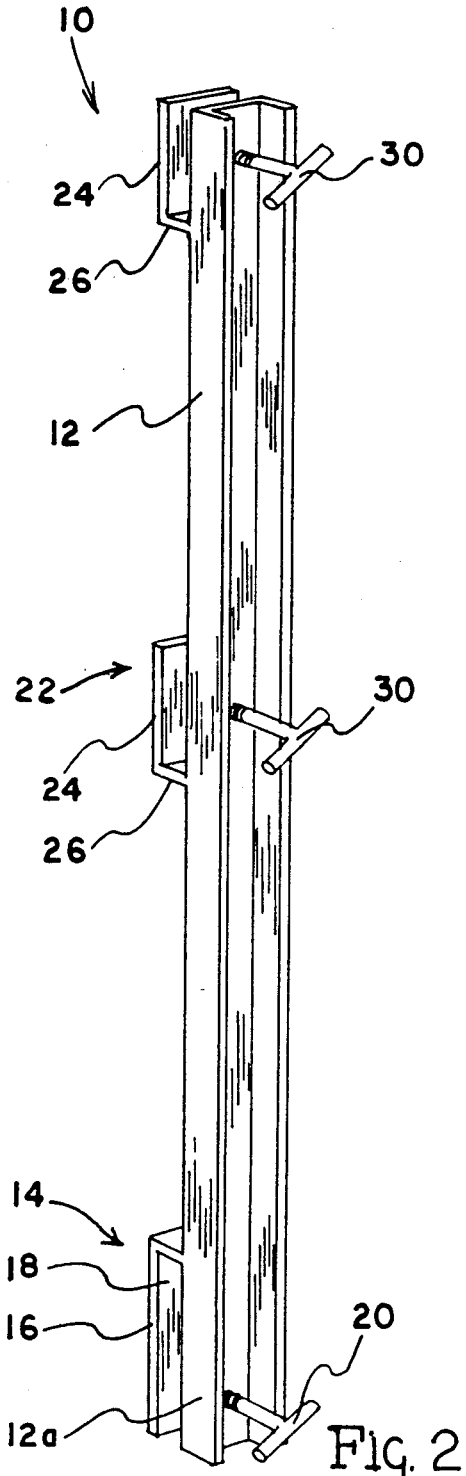
FIG. 2 is a special temporary corner post that forms a part of the temporary railing structure of the present invention.
Figure 3:
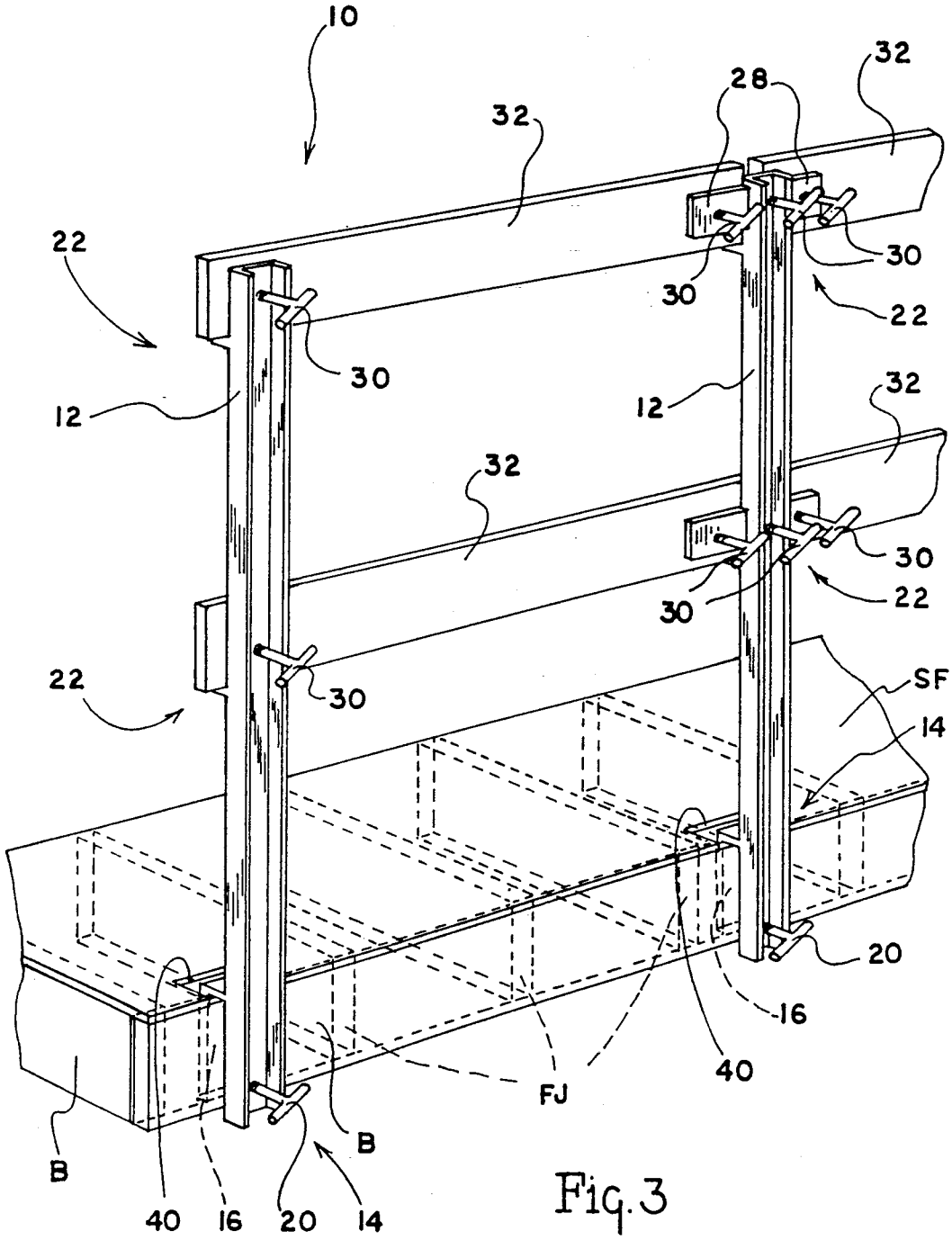
FIG. 3 is a fragmentary perspective view showing the temporary railing structure of the present invention mounted to a floor system.

Formed on the post 12 is at least two rail supports indicated generally by the numeral 22. Rail supports 22 are appropriately spaced on the posts and are adapted to receive and support a horizontal rail such as two-by-fours or two-by-sixes. The particular design of the rail supports 22 will vary to some degree depending on whether the post is a corner post, such as shown in FIG. 2 or an intermediate post which is shown in FIG. 3. First, in the case of a corner post, one is referred to in the drawing in FIG. 2. Here, the rail support structure 22 includes a base 26 that projects outwardly from the post 12 and an upturned leg 24 that extends upwardly from an end of the base 22. Thus, it is appreciated that for a corner version post, as shown in FIG. 2, that the rail supports 22 act to engage and hold simply a terminal end of a horizontal rail 32. Post 12 includes screw-type tighteners 30 which are designed to be screwed into engagement with the end portion of the rail 32 so as to tightly secure the same within the rail supports 22.

Now, turning to FIG. 1, there is shown therein an intermediate temporary rail 12 which is designed to receive and support approaching rails that extend from opposite directions. See the right most post 12 in FIG. 3. In other words, with the intermediate post, as shown in FIG. 1, the same is designed to support two rails 32 end-to-end at two separate vertical positions on the post 12. Turning to the rail support structure for the intermediate post 12, it is seen that the same includes a base 26 and an upper leg portion 24. In addition, there is provided horizontal wings 28 that extend outwardly from both the post and the upper leg 24. This permits two rails to be positioned end-to-end between the wings 28 that form a part of the rail support structure 22 on each intermediate post 12. To secure the rails 32 end-to-end, there is provided screw tighteners 30 that are formed in the outermost wings 28 of each rail support structure 22. There is also provided in the intermediate post a screw-type tightener 30 in the post 12 itself with this central screw-type tightener 30 being disposed between the screw-type tighteners 30 threaded in the wings 28.

To erect and use the temporary railing structure 10 of the present invention, a hole or opening 40 must be formed in the sub-floor itself adjacent the inside of the band B. This permits the inside leg 16 of the attachment means 14 to be inserted downwardly through the opening 40 in the sub-floor. This is done at spaced intervals around the perimeter of the floor under construction. After the yolk or attachment means 14 is inserted over a top portion of the band, the lower screw tightener 20 is turned such that it tightens down on the band B extending through the band cavity 18 of the yolk or attaching means 14. This securely anchors the post 12 to the band B. A series of posts 12 are secured onto the band B at various points and locations around the perimeter of the floor system. See FIG. 3. Next, horizontal rails 32 are connected between the respective posts 12. It is appreciated that at each corner, a pair of corner posts 12, such as that shown in FIG. 2 would be used. The rails 32 can be formed of two-by-fours, two-by-sixes, or the like, and are simply extended from one post to an adjacent post with the rails being supported in the rail supports 22 and the screw-type tighteners 30 screwed down on the rail so as to press them against the opposite structure that forms a part of the rail supports 22.

From the foregoing discussion, it is appreciated that the present invention entails a relatively simple but functional temporary rail support kit or structure that enables one to quickly and easily mount a portable side railing structure around the floor of a building or house under construction.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A portable and temporary railing structure for surrounding a floor of a residential structure where the floor includes underlying floor joists, a band surrounding the floor joists, and a sub-floor disposed over the floor joists and wherein the sub-floor includes a series of spaced apart openings formed through the sub-floor adjacent the inside of the band, and wherein the temporary railing structure includes a series of temporary posts secured to the band and spaced around the outside edge of the floor area and wherein the temporary posts receive and support a series of side railings that extend between the respective posts; and wherein each temporary support posts includes an elongated member having an inverted U-shaped band attachment for attaching the temporary posts to the band and wherein the U-shaped band attachment includes a first outside leg that extends along the outside of the band, a sub-floor penetrator that extends downwardly through the opening within the sub-floor and rests adjacent the inside of the band, and a bolt-type fastener threaded in the first outside leg and movable therein to engage the band so as to secure the entire U-shaped band attachment to the band; and wherein there is provided rail holding means secured on the elongated member for receiving and holding side rails.

2. The temporary railing support structure of claim 1 wherein the rail holding means includes a pair of vertically spaced U-shaped channels with each U-shaped channel adapted to receive a side retaining rail therein.

3. The temporary railing structure of claim 2 wherein each U-shaped channel includes at least one screw-type tightener threadably engaged therein and movable back and forth between an engaged and a disengaged position with respect to the side rails being held and retained by the support posts.

4. The temporary railing structure of claim 3 wherein each U-shaped channel is sufficiently elongated to hold two rails end-to-end, and wherein each U-shaped channel is provided with at least two screw-type tighteners for engaging and holding the end portions of two rails.

5. A method of erecting and disassembling a temporary rail structure around the floor area of a building under construction comprising the steps of:

a) cutting a series of holes in a sub-floor structure adjacent the inside of a surrounding band that surrounds the floor and floor joists supporting the floor;

b) inserting one leg of a U-shaped yoke through a respective hole in the sub-floor and clamping the U-shaped yoke to a top portion of the surrounding band such that the one leg of the U-shaped yoke is held adjacent the inside of the band while extending through the hole in the sub-floor;

c) extending a post upward from the U-shaped yoke to form a temporary post and continuing to add such posts around the floor by the same method;

d) connecting horizontal side rails between respective posts to form a temporary railing structure around the floor of the building under construction; and e) dismounting the entire temporary rail structure by removing the rails and then unclamping the U-shaped yokes from the top of the band and pulling the U-shaped yoke upwardly such that the one leg of the yoke is pulled from the opening within the sub-floor.

6. The method of claim 5 including the step of securing the horizontal rails in end-to-end relationship by supporting the same in U-shaped channels secured to the respective posts.

7. The method of claim 6 including the step of tightening down screw-type tighteners, associated with the U-shaped channel, against respective portions of the rails being held and supported by respective posts.

* * * * *